United States Patent [19]

Hernandez et al.

[11] 4,435,452

[45] Mar. 6, 1984

[54] LIL GOLDEN PINE NOVELTY DISPLAY DEVICE

[76] Inventors: Ruben R. Hernandez; Freda M. Hernandez, both of 156 McKinney Ave., Pacifica, Calif. 94044

[21] Appl. No.: 433,289

[22] Filed: Jan. 31, 1983

[51] Int. Cl.[3] ..... A47G 33/06; B44C 5/04

[52] U.S. Cl. ..... 428/17; D11/118; 156/63; 156/297; 428/18; 428/39; 428/913.3

[58] Field of Search ..... 428/7, 11, 13, 16, 17, 428/18, 19, 20, 913.3, 14, 39, 537; 156/63, 57, 297; D11/118; 362/123

[56] References Cited

U.S. PATENT DOCUMENTS

| | | | |
|---|---|---|---|
| 1,678,226 | 7/1928 | Leigh | 428/16 X |
| 1,773,824 | 8/1930 | Scheibner | 428/11 X |
| 2,309,977 | 2/1943 | Peroni | 428/18 X |
| 2,702,441 | 2/1955 | Jones | 428/913.3 X |
| 2,876,575 | 3/1959 | Leika | 428/14 X |
| 2,937,931 | 5/1960 | Nugent | 428/39 X |
| 3,976,807 | 8/1976 | Sweeney | 428/16 |
| 4,106,228 | 8/1978 | Gibrich | D11/118 X |

*Primary Examiner*—Henry F. Epstein

[57] ABSTRACT

A wall decoration in the shape of a pine tree; including a base made of plywood panels glued one upon another, pine cone scales glued on the front side thereof, and a gold panel applied to the front of this assembly.

1 Claim, 3 Drawing Figures

LIL GOLDEN PINE NOVELTY DISPLAY DEVICE

This invention relates generally to novelty display devices. More specifically, it relates to wall-mounted decorations.

It is well known that during holiday seasons, particularly such as during Christmas time, most persons like to decorate their homes with holiday decorations, in order to convey the friendly spirit of the time. Accordingly, decorations are often hung in windows, from ceilings and on the walls of their homes.

It is a principal object of the present invention to provide a novel decoration that can be displayed from a wall, and which is totally different from the usual decorations that are now being sold, the decoration being attractive and artistic in appearance.

Another object is to provide a novelty display device, which can be made in any of various shapes, so as to conform to designs associated with particular holidays such as a Christmas tree for Christmastime, or else which may be made as an attractive decoration for permanent year-round display.

Other objects are to provide a novelty display device, which is simple in design, inexpensive to manufacture, rugged in construction, easy to use, and efficient in operation.

These, and other objects, will be readily evident, upon a study of the following specification, and the accompanying drawing, wherein.

Figure 1:
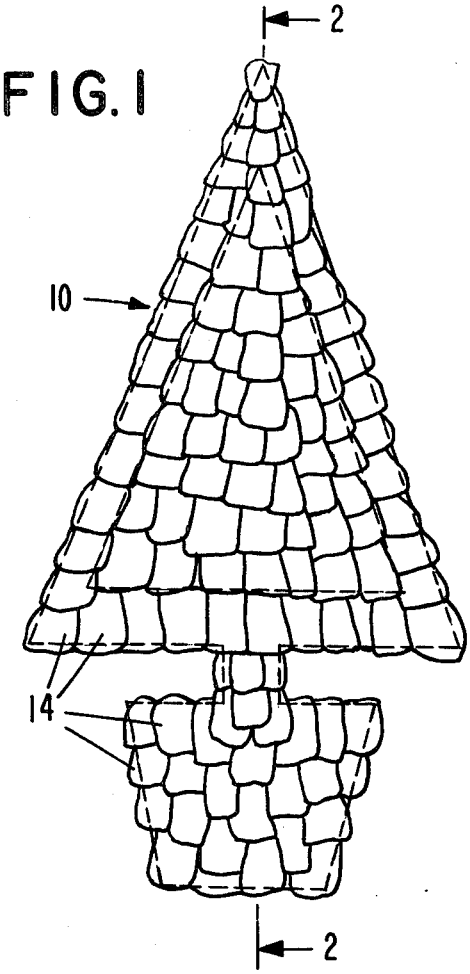
FIG. 1 is a front elevation view of the invention.
Figure 2:
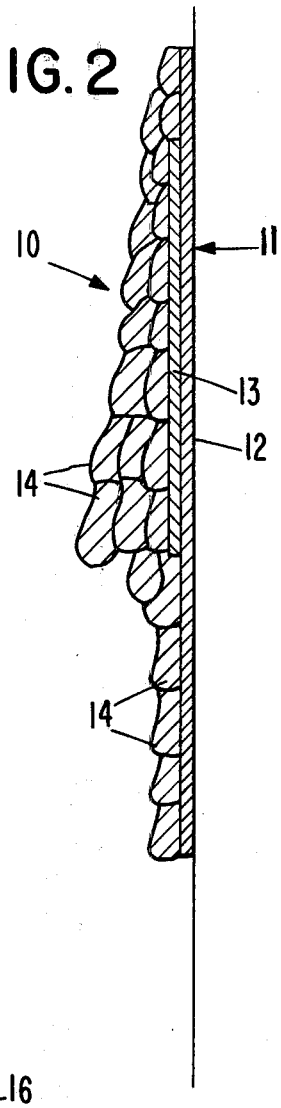
FIG. 2 is a side cross-sectional view, taken on line 2—2 of FIG. 1.

Referring now to the drawing in greater detail, and more particularly to FIGS. 1 and 2 thereof, at this time, the reference numeral 10 represents a novelty display device 10, according to the present invention, wherein there is a mounting base 11, comprising a plurality of flat panels of various different shapes and sizes, adhered together, one upon another, in order to build up a three dimensional contour, and which, in the present example of the invention, includes a larger main panel 12, upon a front side of which there is a smaller panel 13, the main panel being in the shape of a pine tree, having its trunk standing in a tub, while the secondary panel 13 is triangular-shaped and is located only in front of that portion of the tree which represents the branches of the tree. The panels may be cut out from plywood or other suitable material.

In one practical size of the device, the main panel is made approximately eight inches wide and fifteen inches overall in height, while the secondary panel is approximately four and one-half inches wide and eight inches high.

Upon a front side of the assembled base 11, there are glued a quantity of actual pine cone scales 14, as shown. In the illustrated example, they are piled to a thickness of approximately one and one-half inches at the lower portion of the tree branches area, while tapering to a single thickness of scales at the top of the tree. A single layer of the scales cover the tree trunk and tub. Thereafter, the front of the device is sprayed with a gold paint. A hook (not shown) may be attached at the rear, for hanging on a wall.

Figure 3:
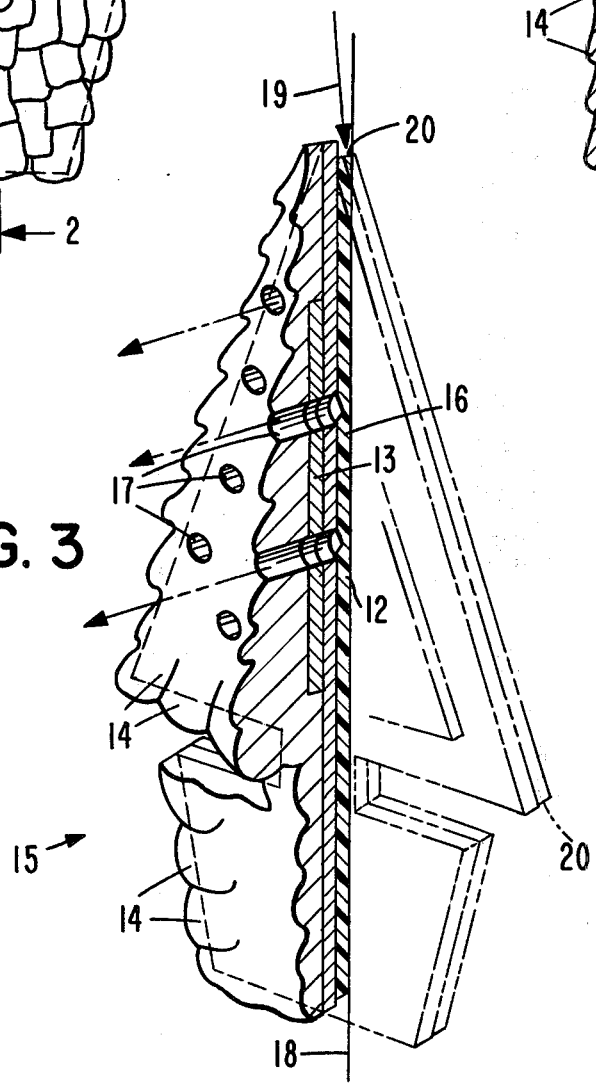
FIG. 3 is a cross-sectional perspective view of another design of the invention, that includes a lucite panel on its rear, and a few holes drilled from the front to it so as to create an effect of illuminated Christmas tree lights.

In a modified design 15 of the invention, shown in FIG. 3, a sheet of Lucite 16 is adhered to the rear side of the device 10, the Lucite sheet being contoured slightly smaller than the main panel, so as not to be seen as readily. A plurality of holes 17 are drilled through the device 10, and into the front side of the Lucite, in order to roughen the Lucite surface at this portion. Then, after the device is hung on a wall 18, light rays 19 from the room can enter the edge 20 of the lucite sheet, and illuminate the drilled-out portion of the holes 17 that extend into the Lucite sheet, and which illumination is thus made visible to a person in front of the display, which thus looks like a lighted Christmas tree.

While various changes may be made in the detail construction, it is understood that such changes will be within the spirit and scope of the present invention, as is defined by the appended claims.

What we claim as new, is:

1. A novelty display device, comprising, in combination, a plurality of flat, variously-shaped panels glued one flat side upon another, forming a three dimensional contoured base, and a plurality of pine cone scales glued to the front side of said base; a gold paint coating being applied on the front of said pine cone scales; a flat sheet of Lucite being adhered to the rear side of said base, said Lucite sheet being contoured smaller than said base, and a plurality of holes drilled from the front side of said device, through said base and into the front side of said Lucite forming a roughened surface in said Lucite drilled-out portions of said holes, whereby exterior light rays upon an edge of said Lucite sheet illuminate said drilled-out, roughened Lucite surface.

* * * * *